US011639575B2

(12) United States Patent
Jo et al.

(10) Patent No.: US 11,639,575 B2
(45) Date of Patent: May 2, 2023

(54) WASHING MACHINE

(71) Applicant: SAMSUNG ELECTRONICS CO., LTD., Suwon-si (KR)

(72) Inventors: Geonhui Jo, Suwon-si (KR); Wonseok Choi, Suwon-si (KR); Yongchan Kwon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 13 days.

(21) Appl. No.: 16/932,026

(22) Filed: Jul. 17, 2020

(65) Prior Publication Data

US 2021/0017691 A1 Jan. 21, 2021

(30) Foreign Application Priority Data

Jul. 17, 2019 (KR) ..... 10-2019-0086450

(51) Int. Cl.

| | |
|---|---|
| ***D06F 39/02*** | (2006.01) |
| ***D06F 21/04*** | (2006.01) |
| ***E05C 3/14*** | (2006.01) |
| ***E05B 65/46*** | (2017.01) |
| ***D06F 39/12*** | (2006.01) |

(52) U.S. Cl.

CPC ..... *D06F 39/028* (2013.01); *D06F 21/04* (2013.01); *D06F 39/12* (2013.01); *E05B 65/46* (2013.01); *E05C 3/14* (2013.01); *E05Y 2900/312* (2013.01)

(58) Field of Classification Search

CPC ..... D06F 33/37; D06F 33/57; D06F 34/08; D06F 39/02; D06F 39/022; D06F 39/028; D06F 2103/22; D06F 2105/58; D06F 2105/60

See application file for complete search history.

(56) References Cited

U.S. PATENT DOCUMENTS

| | | | | |
|---|---|---|---|---|
| 2004/0093913 | A1* | 5/2004 | Bolduan | D06F 39/02 68/19.2 |
| 2009/0261697 | A1* | 10/2009 | Hill | D06F 39/02 312/333 |
| 2016/0153133 | A1* | 6/2016 | Del Pos | D06F 34/28 68/17 R |

FOREIGN PATENT DOCUMENTS

| | | |
|---|---|---|
| KR | 20-0119512 | 2/1996 |
| KR | 20-0243542 | 9/2001 |
| KR | 20-0428115 | 10/2006 |

* cited by examiner

*Primary Examiner* — David G Cormier

(74) *Attorney, Agent, or Firm* — Staas & Halsey LLP

(57) ABSTRACT

Disclosed is a detergent supply device having an improved locking structure and a washing machine including the same. The washing machine includes a main body, a tub disposed inside the main body to accommodate water, a detergent case configured to supply a detergent to the tub, and a locking device configured to detachably connect the detergent case to the main body, wherein the locking device includes a first locking member disposed in the main body, and a second locking member disposed in the detergent case to unlock or lock the first locking member by being pressed or released.

20 Claims, 13 Drawing Sheets

WASHING MACHINE

CROSS-REFERENCE TO RELATED APPLICATION(S)

This application is based on and claims priority under 35 U.S.C. § 119 to Korean Patent Application No. 10-2019-0086450, filed on Jul. 17, 2019, in the Korean Intellectual Property Office, the disclosure of which is incorporated by reference herein in its entirety.

BACKGROUND

1. Field

The disclosure relates to a washing machine, and more particularly, to a detergent supply device having an improved locking structure and a washing machine including the same.

2. Description of the Related Art

Generally, a washing machine is a device for washing laundry by rotating a cylindrical rotary tub containing the laundry and washing water. As a type of washing machine, there are a drum washing machine in which laundry is washed by falling down after being lifted upward along an inner circumferential surface of a rotary tub as the rotary tub, which is disposed substantially horizontally, rotates in the forward and reverse directions with respect to a horizontal axis, and a vertical axis washing machine in which laundry is washed using a water current generated by a pulsator disposed inside a rotary tub as the rotary tub, which is disposed substantially vertically, rotates in the forward and reverse directions with respect to a vertical axis.

A drum washing machine includes a cabinet forming an outer appearance, a drum rotated inside the cabinet by a rotational force of a motor, a tub disposed between the drum and the cabinet to accommodate washing water, a front panel mounted on a front side of the cabinet and having a center opening to allow laundry to be put therein and taken out therefrom, and a door installed on the front panel to open and close the opening and preventing the laundry from escaping.

A detergent supply device for supplying washing water mixed with a detergent to the tub is installed at an upper portion of the drum washing machine.

The detergent supply device is disposed in an upper front side of the drum washing machine and includes a box-shaped case with an open front, and a drawer-type detergent container mounted on the case to be movable in and out of the case through the open front of the case.

A user may open or close the case by pulling or pushing the detergent container.

Recently, an automatic detergent supply device, which may automatically supply a detergent or a softener of a required amount by a pump during each washing after the amount of liquid detergent or softener to be able to be supplied dozens of times is stored in advance, is used.

In the case of such an automatic detergent supply device, a connection structure between the washing machine case and the detergent container becomes complicated, so that in closing and opening operations, a large difference in a resistance force occurs, and at the same time, mechanically combining and separating may be difficult.

In addition, when the detergent container of the detergent supply device and a combining portion of the washing machine body are not firmly combined, the detergent may not be supplied or the detergent may be supplied at an inappropriate timing.

SUMMARY

In accordance with an aspect of the disclosure, a washing machine includes a main body, a tub disposed inside the main body to accommodate water, a detergent case configured to supply a detergent to the tub, and a locking device configured to detachably connect the detergent case to the main body, wherein the locking device includes a first locking member disposed in the main body, and a second locking member disposed in the detergent case to lock or unlock the first locking member by being pressed.

The main body may include a counterpart configured such that the detergent case is installed, and the first locking member may be provided on the counterpart.

The first locking member may include a first locking portion formed to be in contact with at least a portion of the second locking member, and the first locking portion may include a first locking surface having an inclination of a first angle.

The counterpart may include at least one of a front panel provided in front of the main body and a frame provided inside the main body such that the detergent case is installed.

The first locking surface may be formed on at least a portion of the counterpart.

The second locking member may include a pressing portion rotatably installed in the detergent case, a second locking portion extending from the pressing portion to correspond to the first locking portion, and a rotation shaft supporting the second locking portion to be rotated by pressing of the pressing portion.

The second locking portion may be provided to correspond to the first locking surface and may include a second locking surface having an inclination of a second angle.

The second angle may be greater than or equal to the first angle.

The washing machine may further include an elastic member elastically supporting the second locking member.

The elastic member may be disposed between the detergent case and the second locking member.

The detergent case may include a detergent case body configured to accommodate the detergent, a handle provided in front of the detergent case body to be gripped by a user, and a second locking portion installation portion provided between the handle and the detergent case body such that the second locking member is installed.

The second locking portion installation portion may include a second locking member installation bracket configured such that the second locking member is rotatably installed.

When the second locking portion is locked with the first locking portion, the second locking portion may be exposed to the outside of the second locking portion installation portion.

When the second locking portion is unlocked with the first locking portion, the second locking portion may be moved to the inside of the second locking portion installation portion.

In accordance with another aspect of the disclosure, a washing machine includes a main body, and a detergent supply device mounted on the main body, wherein the detergent supply device includes a detergent case configured to accommodate a detergent, and a locking device locking or unlocking the detergent case such that a detergent case is detachable connected to the main body, and wherein the locking device includes a first locking member provided in the main body, and a second locking member disposed in the detergent case and configured to lock or unlock the first locking member by pressing of a user.

The first locking member may include a first locking portion formed to be in contact with at least a portion of the second locking member, and the first locking portion may include a first locking surface having an inclination of a first angle.

The second locking member may include a second locking portion extending from the pressing portion to correspond to the first locking portion, and a rotation shaft supporting the second locking portion to be rotated by pressing of the pressing portion.

The second locking portion may be provided to correspond to the first locking surface and may include a second locking surface having an inclination of a second angle.

The second angle may be greater than or equal to the first angle.

The washing machine may further include an elastic member disposed between the detergent case and the second locking member to elastically support the second locking member.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various drawings of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

It is an aspect of the disclosure to provide a detergent supply device with an improved locking structure and a washing machine including the same.

It is another aspect of the disclosure to provide a detergent supply device with an improved locking structure for easy withdrawal and fastening of a detergent case and a washing machine including the same.

It is another aspect of the disclosure to provide a detergent supply device capable of improving usability by providing a constant force for opening and dosing the detergent case and a washing machine including the same.

Hereinafter, embodiments of the disclosure will be described in detail with reference to the accompanying drawings.

Figure 1:
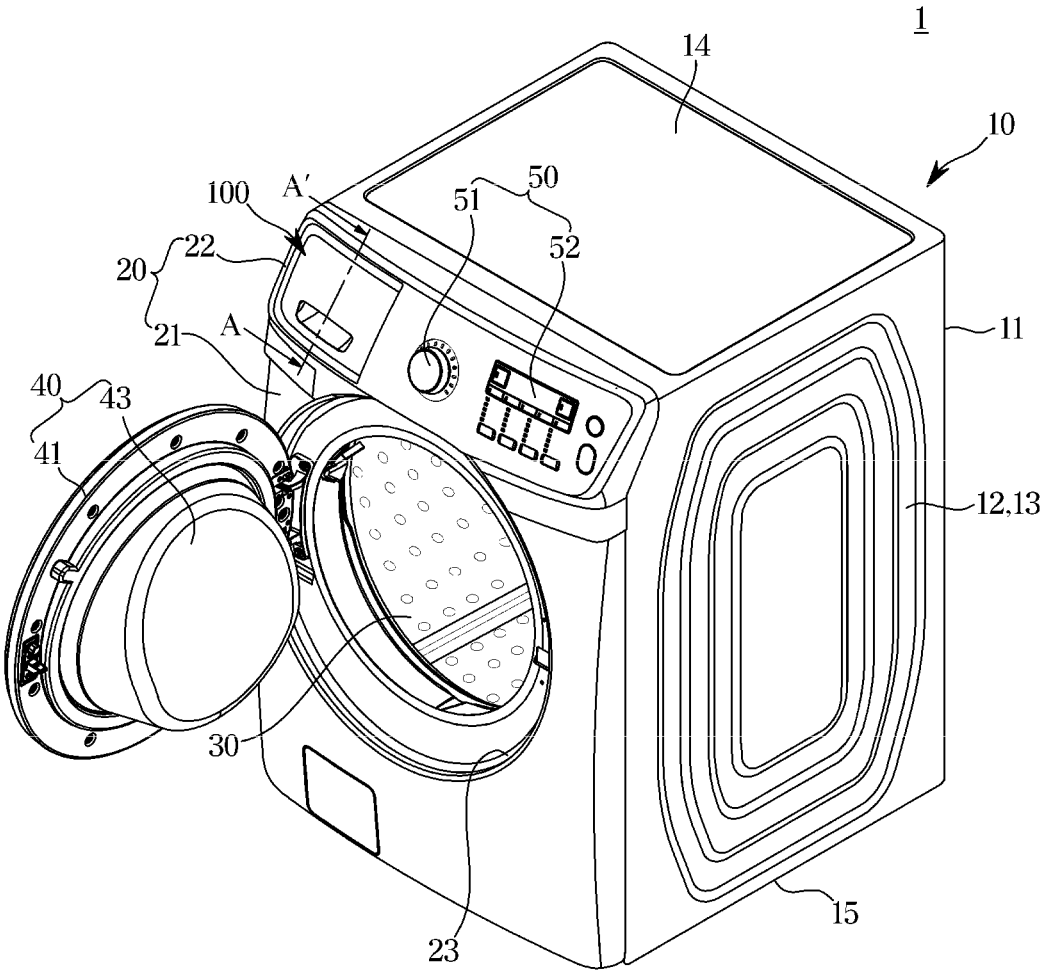
FIG. 1 is a perspective view of a washing machine according to an embodiment of the disclosure.
Figure 2:
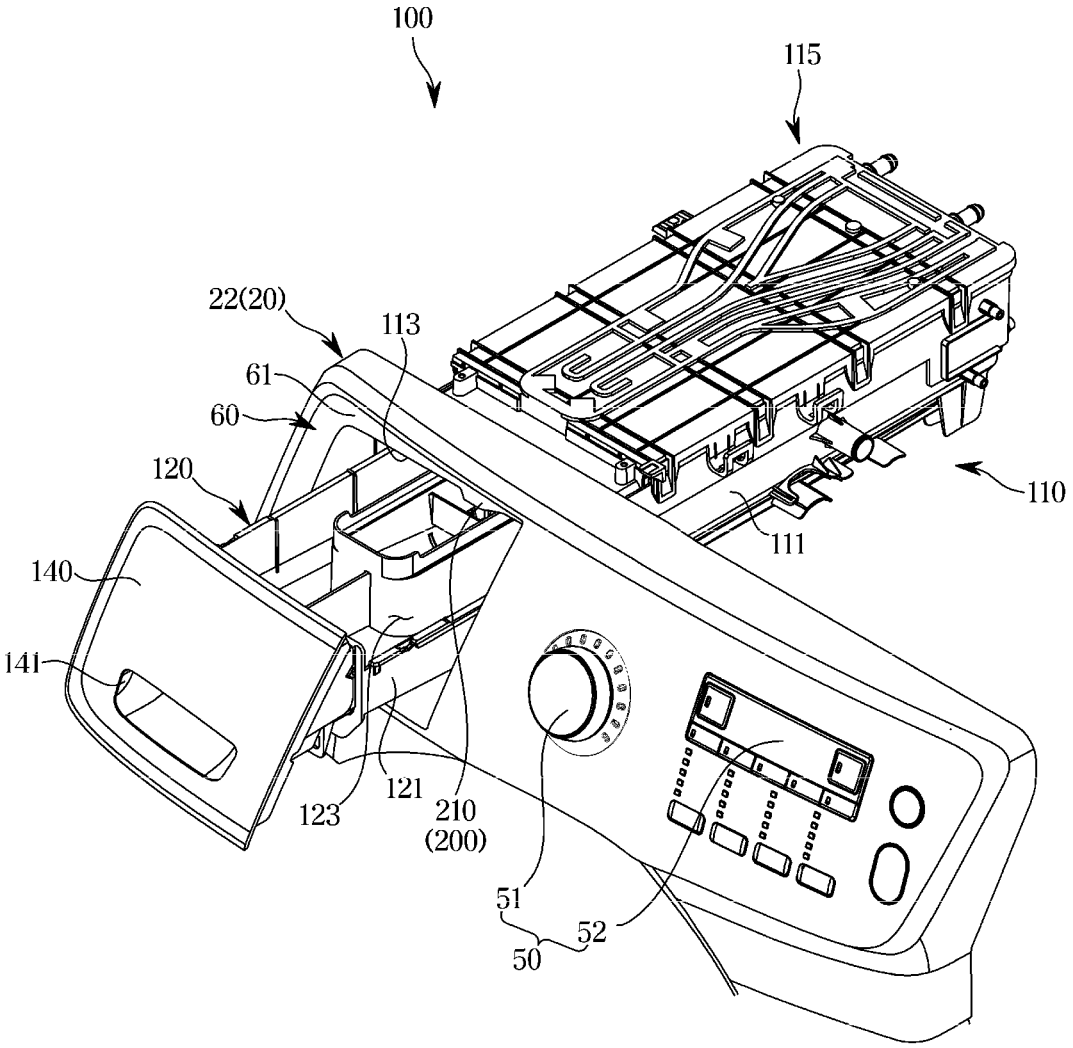
FIG. 2 illustrates a washing machine equipped with a detergent case to which a locking device is applied according to an embodiment of the disclosure.
Figure 3:
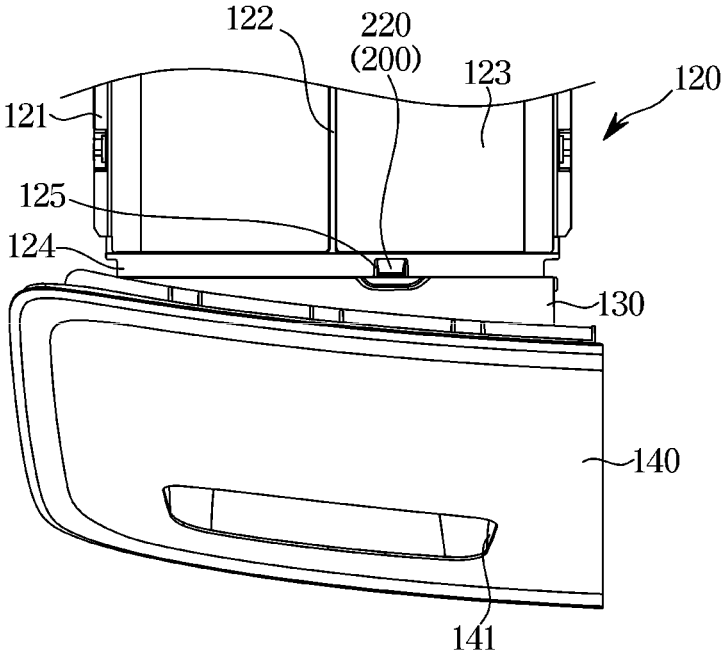
FIG. 3 is a plan view of the detergent case to which the locking device is applied according to an embodiment of the disclosure.

FIG. 1 is a perspective view of a washing machine according to an embodiment of the disclosure, FIG. 2 illustrates a washing machine equipped with a detergent case to which a locking device is applied according to an embodiment of the disclosure, and FIG. 3 is a plan view of the detergent case to which the locking device is applied according to an embodiment of the disclosure.

As illustrated in FIGS. 1 to 3, a washing machine 1 includes a main body 10 forming an outer appearance and configured to accommodate various components therein, a tub (not shown) disposed inside the main body 10 to store mixed water in which washing water and a detergent are mixed, a rotatable drum 30 disposed inside the tub to receive laundry, and a driving device (not shown) for rotating the drum 30. The driving device (not shown) may rotate the drum 30 forward and backward in the rear of the tub to perform washing, rinsing, and dehydrating operations.

The main body 10 may be formed in a substantially hexahedral shape. The main body 10 may be formed in a box shape with an open front side. The main body 10 may include a rear surface 11 and opposite side surfaces 12 and 13 disposed on one side and the other side in the front of the rear surface 11. The front panel 20 may be provided on the open front side of the main body 10, and a top cover 14 and a base 15 may be provided on upper and lower sides, respectively. The top cover 14 and the base 15 may be formed of rectangular plates having sizes corresponding to the upper and lower sides of the main body 10, respectively.

The front panel 20 may include a first front panel 21 and a second front panel 22 disposed above the first front panel 21.

The first front panel 21 may be disposed on the front side of the main body 10. A lower end of the first front panel 21 may be coupled to the base 15. An opening 23 may be formed on the first front panel 21 to allow laundry to be put into and taken out of the drum 30. The opening 23 of the first front panel 21 is formed to allow laundry to be put or taken through the front side of the main body 10. The opening 23 of the first front panel 21 may be opened and closed by a door 40. The door 40 may include a door frame 41 and a door glass 43. The door glass 43 may be formed of a transparent tempered glass material so that the inside of the main body 10 may be viewed.

The second front panel 22 may be provided on an upper front side of the main body 10. The second front panel 22 may be disposed above the first front panel 21. An upper end of the second front panel 22 may be coupled to the top cover 14.

The second front panel 22 may be provided with a control panel 50 including an input 51 for receiving an operation command from a user and a display 52 for displaying operation information of the washing machine 1.

A detergent supply device 100 for supplying a detergent into the tub may be installed in the second front panel 22. The second front panel 22 may include a detergent supply device installation portion 60 formed by cutting at least a portion thereof. The disclosure illustrates that the detergent supply device installation portion 60 is formed on the left side of the second front panel 22, but is not limited thereto. For example, the detergent supply device installation portion 60 may be formed on the right side of the second front panel 22 or may also be formed on the first front panel 21.

Water supply valves (not shown) and water supply pipes (not shown) connected to an external water supply source (not shown) to supply washing water to the inside of the tub and to control water supply may be installed above the tub. The water supply pipes may be connected to the detergent supply device 100.

The detergent supply device 100 may be connected to the tub through a supply pipe (not shown). Washing water is mixed with the detergent through the detergent supply device 100, and the mixed water in which the washing water and the detergent are mixed may be supplied into the tub.

A drain pump (not shown) and a drain pipe (not shown) for forcibly draining washing water inside the tub to the outside of the main body 10 after washing is finished may be provided below the tub.

The detergent supply device 100 may be installed in the second front panel 22. The detergent supply device 100 may be installed on the detergent supply device installation portion 60. A detergent case cover installation surface 61 may be formed on the detergent supply device installation portion 60 so that a detergent case cover 140 of the detergent supply device 100, which will be described later, may be coupled thereto. It is appropriate that the detergent case cover installation surface 61 is formed by being recessed toward an inner side of the second front panel 22.

The detergent supply device 100 may supply a detergent in an automatic detergent supply method or a manual detergent supply method according to the selection of the user, and in the automatic detergent supply method, the detergent may be additionally supplied as the user needs.

The input 51 of the control panel 50 may be provided with a dial or a button for supplying the detergent so that the user may select the supply of the detergent.

The detergent supply device 100 may include a housing 110 installed inside the main body 10, a detergent case 120 accommodating a detergent and a softener and movably coupled to the inside of the housing 110, and a locking device 200 configured to lock or unlock the detergent case 120 so that the detergent case 120 may be separated from the main body 10.

The detergent supply device 100 may further include a water supply unit 115 coupled to the housing 110 or the detergent case 120 to supply water.

The housing 110 may include a housing body 111 accommodating the detergent case 120 therein, and a housing opening 113 formed on a front side of the housing body 111 to allow the detergent case 120 to be withdrawn outside or put inside. The housing 110 is configured to guide the detergent case 120 to be withdrawn outside or put inside. The housing 110 may be disposed at an inner upper portion of the main body 10. The disclosure illustrates that the housing 110 is disposed at the left side of the inner upper portion of the main body 10, but is not limited thereto. For example, the housing 110 may be disposed at a lower portion of the main body 10.

The detergent case 120 may be installed to be movable inside and outside the housing 110 through the housing opening 113 of the housing 110. The detergent case 120 may include a detergent case body 121 and the detergent case cover 140 provided in front of the detergent case body 121. The detergent case cover 140 may include a handle 141 provided to be gripped by the user. The handle 141 may be formed by recessing at least a portion of the detergent case cover 140. The handle 141 may be provided in front of the detergent case body 121. The detergent case cover 140 may be formed to correspond to the detergent supply device installation portion 60 of the front panel 20. At least a portion of a rear surface of the detergent case cover 140 may be formed to correspond to the detergent case cover installation surface 61 of the detergent supply device installation portion 60.

The detergent case body 121 is formed in a box shape with an open upper side. The inside of the detergent case body 121 may be partitioned by a plurality of partition walls 122. A plurality of detergent accommodating portions 123 is formed in the inside of the detergent case body 121 partitioned by the plurality of partition walls 122, and a detergent container (not shown) and a softener container (not shown) for accommodating a detergent and a softener may be mounted in the plurality of detergent accommodating portions 123.

The detergent case cover 140 is installed to cover a front side of the detergent case body 121. The detergent case cover 140 and the detergent case body 121 may be combined in a hook manner.

A detergent case bracket 130 may be provided between the detergent case cover 140 and the detergent case body 121. The detergent case cover 140 may be coupled to a front surface of the detergent case bracket 130. The detergent case bracket 130 may be coupled to a front surface of the detergent case body 121.

The locking device 200, which will be described later, may be installed on the detergent case bracket 130. The disclosure illustrates that the detergent case bracket 130 is separately provided and combined in front of the detergent case body 121, but is not limited thereto. For example, the detergent case bracket 130 may be integrally formed with the detergent case body 121.

The locking device 200 for detachably connecting the detergent case 120 to the main body 10 may include a first locking member 210, and a second locking member 220 provided to lock or unlock the first locking member 210.

The first locking member 210 may be disposed in the main body 10. The first locking member 210 may be provided on the second front panel 22 of the main body 10. The first locking member 210 may be provided in the detergent supply device installation portion 60 of the second front panel 22. The first locking member 210 may be provided on a counterpart where the detergent case 120 is installed. The counterpart where the detergent case 120 is installed may be provided in the main body 10. The counterpart may include a separate frame (not shown) provided inside the main body 10 such that the front panel 20 provided on the front side of the main body 10 and the detergent case 120 are installed.

The second locking member 220 may be disposed in the detergent case 120. The second locking member 220 may be configured to lock or unlock the first locking member 210 by rotating as the user presses the second locking member 220.

At least a portion of the second locking member 220 may be exposed to the outside of the detergent case 120. The detergent case 120 may be provided with a second locking portion installation opening 125 to expose the at least a portion of the second locking member 220. The second locking portion installation opening 125 may be formed by opening a portion of an upper surface of the detergent case 120. The second locking member 220 may be exposed or non-exposed by rotating through the second locking portion installation opening 125 formed on the upper surface of the detergent case 120.

Figure 4:
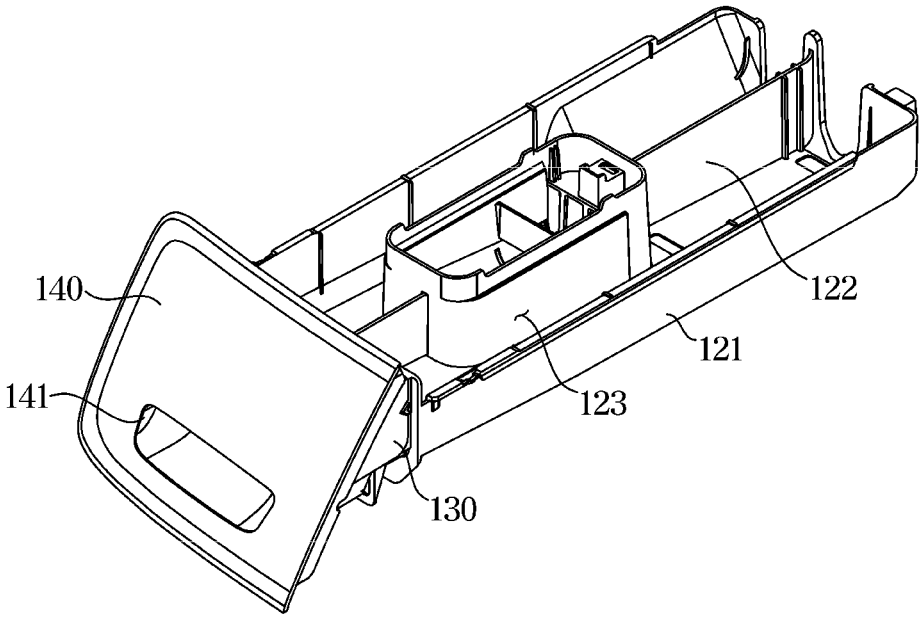
FIG. 4 is a partially exploded perspective view of the detergent case installed in a main body according to an embodiment of the disclosure.
Figure 5:
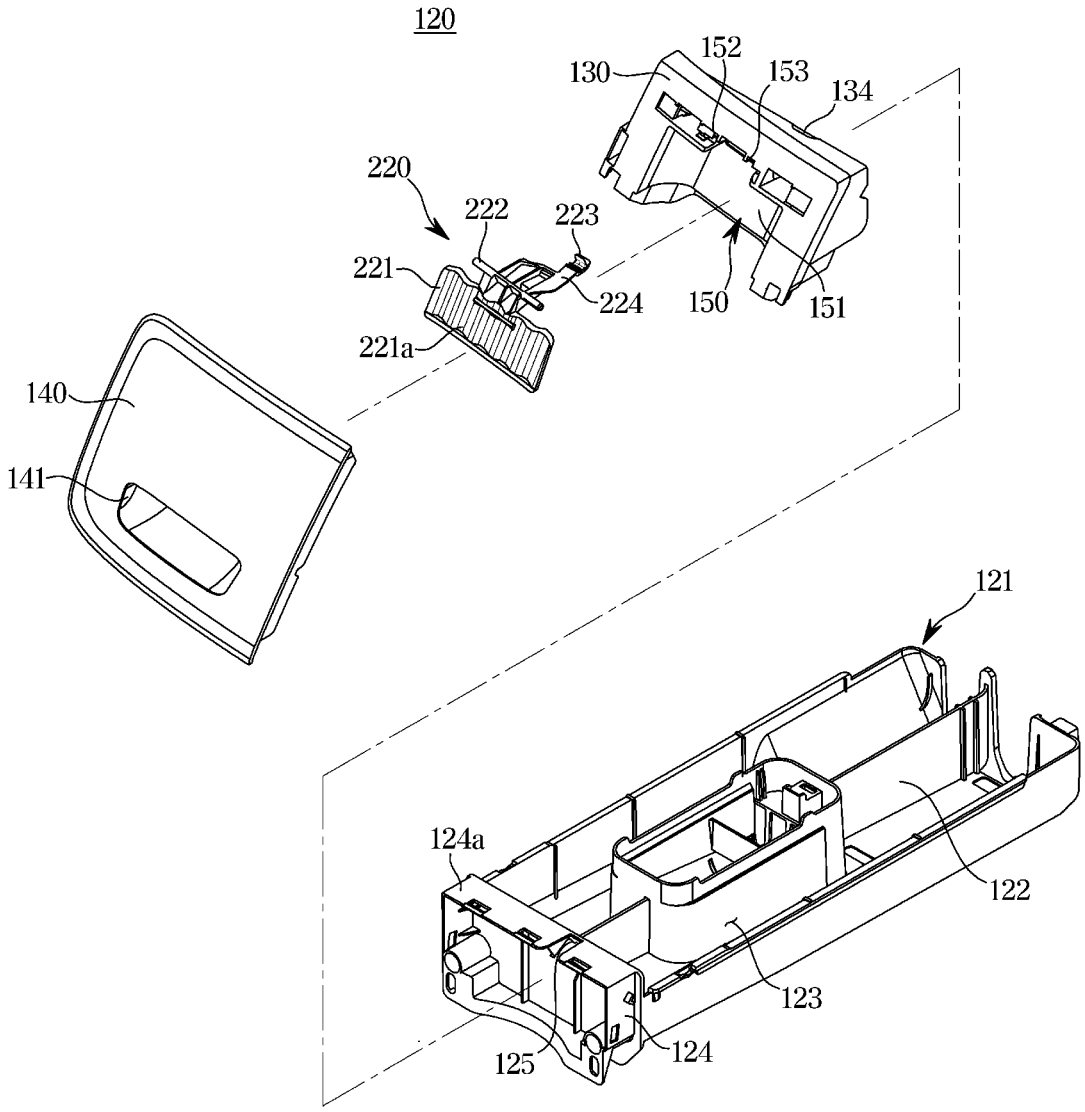
FIG. 5 is an exploded perspective view of the detergent case according to an embodiment of the disclosure.
Figure 6:
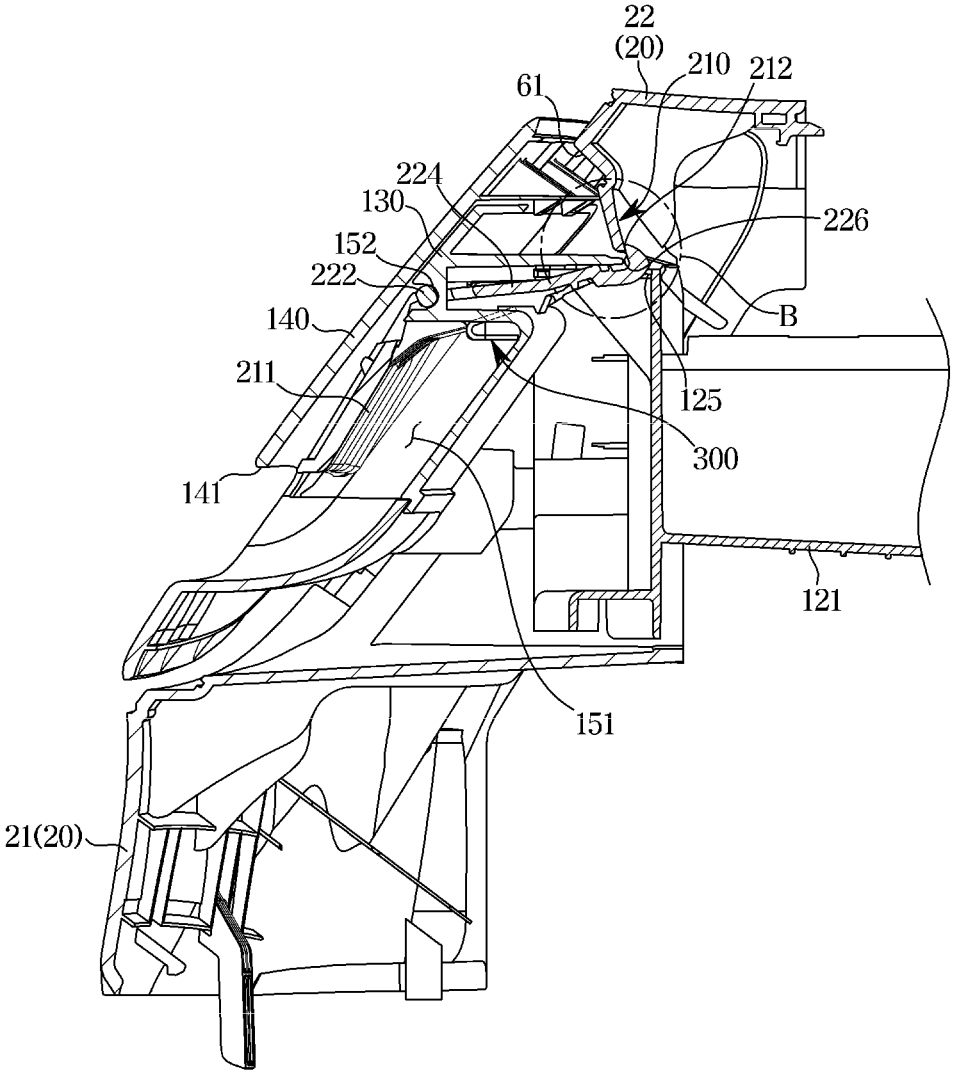
FIG. 6 is a cross-sectional view taken along line A-A' in FIG. 1, illustrating the locking device of the detergent case according to an embodiment of the disclosure.
Figure 7:
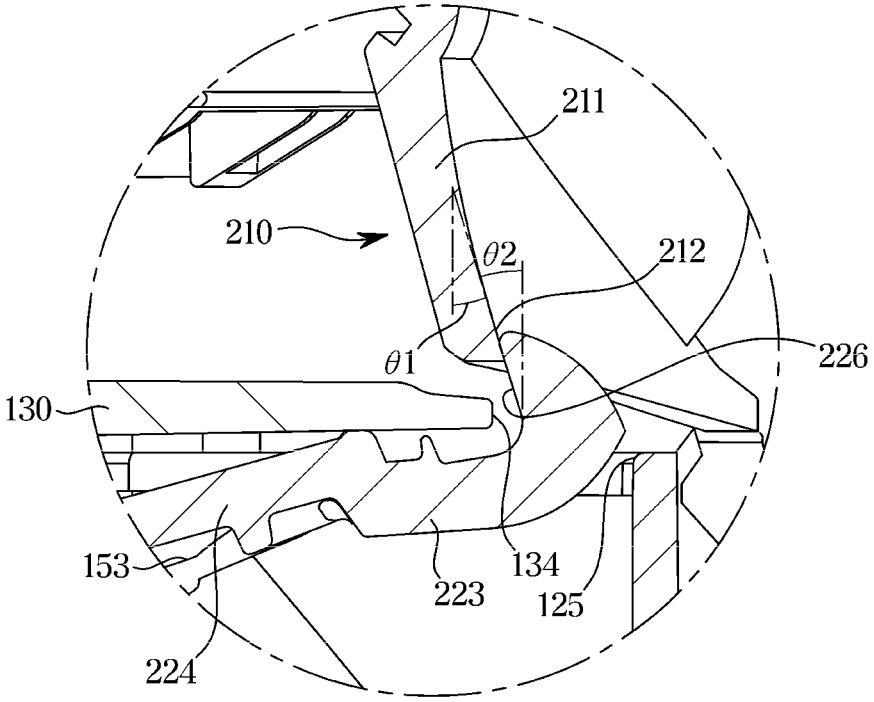
FIG. 7 is an enlarged view of a portion B in FIG. 6, illustrating the locking device according to an embodiment of the disclosure.

FIG. 4 is a partially exploded perspective view of the detergent case installed in a main body according to an embodiment of the disclosure, FIG. 5 is an exploded perspective view of the detergent case according to an embodiment of the disclosure, FIG. 6 is a cross-sectional view taken along line A-A' in FIG. 1, illustrating the locking device of the detergent case according to an embodiment of the disclosure, and FIG. 7 is an enlarged view of a portion B in FIG. 6, illustrating the locking device according to an embodiment of the disclosure.

As illustrated in FIGS. 4 and 7, the detergent case 120 of the detergent supply device 100 may include the detergent case body 121 and the detergent case cover 140 provided in front of the detergent case body 121.

The detergent case body 121 is formed in a box shape with the open upper side. The detergent case cover 140 is installed to cover the front side of the detergent case body 121. The detergent case cover 140 and the detergent case body 121 may be combined in a hook manner.

A detergent case body bracket 124 may be provided on the front surface of the detergent case body 121. The detergent case body bracket 124 is provided such that the detergent case bracket 130 may be coupled thereto. The detergent case body bracket 124 may be formed to correspond to the size and shape of the detergent case body 121. The second locking portion installation opening 125 for installing the second locking member 220 may be formed on an upper surface 124*a* of the detergent case body bracket 124. The second locking portion installation opening 125 may be formed by cutting at least a portion of the upper surface 124*a* of the detergent case body bracket 124. The second locking portion installation opening 125 may be formed by cutting in a moving direction of the detergent case 120 on the upper surface 124*a* of the detergent case body bracket 124.

The detergent case bracket 130 may be coupled from front of the detergent case body bracket 124. The detergent case bracket 130 may be provided with a second locking portion installation hole 134 corresponding to the second locking portion installation opening 125 of the detergent case body bracket 124. The second locking portion installation opening 125 is connected by the second locking portion installation hole 134 of the detergent case bracket 130 coupled from the front, so that a second locking portion 223 of the second locking member 220 may be exposed or non-exposed.

The detergent case bracket 130 may be provided between the detergent case cover 140 and the detergent case body 121. The detergent case cover 140 may be coupled to the front surface of the detergent case bracket 130.

The detergent case bracket 130 may be provided with a second locking portion installation portion 150 for installing the second locking device 200. The second locking portion installation portion 150 may be provided in front of the detergent case bracket 130.

The second locking portion installation portion 150 may include a second locking member accommodating groove 151 formed to accommodate the second locking member 220, a rotation shaft coupling portion 152 provided above the second locking member accommodating groove 151, and a second locking portion through portion 153 through which at least a portion of the second locking member 220 penetrates and is rotatably installed. The second locking portion through portion 153 may be connected to the second locking portion installation hole 134.

The detergent case cover 140 may be disposed in front of the second locking portion installation portion 150. The second locking portion installation portion 150 may be covered by the detergent case cover 140 coupled to the front surface of the detergent case bracket 130. The user may press the second locking member 220 through the handle 141 formed on the detergent case cover 140. The user may rotate the second locking member 220 by pressing the second locking member 220 through the handle 141 formed on the detergent case cover 140.

The second locking member 220 may include a pressing portion 221, the second locking portion 223 extending from the pressing portion 221 to lock or unlock the first locking member 210, and a rotation shaft 222 supporting the second locking portion 223 to be rotated by pressing of the pressing portion 221.

The pressing portion 221 of the second locking member 220 may be disposed in rear of the handle 141 of the detergent case cover 140. The pressing portion 221 may be provided to be gripped by the user through the handle 141 of the detergent case cover 140. The pressing portion 221 may be formed in a shape and size corresponding to the second locking portion installation portion 150 of the detergent case bracket 130. The pressing portion 221 may be provided to be accommodated in the second locking member accommodating groove 151. The pressing portion 221 may be formed in a plate shape including a plurality of curved surfaces 221*a* to improve the user's manipulation texture. The pressing portion 221 is provided such that the user may pull the pressing portion 221 forward through the handle 141. The rotation shaft 222 may be provided on the pressing portion 221. The rotation shaft 222 may be formed at an upper end of the pressing portion 221. The pressing portion 221 may be connected to the second locking portion 223 through the rotation shaft 222. The second locking portion 223 may include a rotation arm 224 connected to the rotation shaft 222. The rotation arm 224 may connect the rotation shaft 222 and the second locking portion 223. When the pressing portion 221 is pressed forward by the user, the rotation arm 224 rotates about the rotation shaft 222 so that the second locking portion 223 is rotated in a downward direction.

When pressing of the pressing portion 221 is released by the user, the rotation arm 224 rotates about the rotation shaft 222 so that the second locking portion 223 is rotated in an upward direction.

The second locking member 220 may include an elastic member 300 for elastically supporting the detergent case 120. The elastic member 300 may be disposed between the detergent case 120 and the second locking member 220. The elastic member 300 elastically supports at least a portion of the detergent case 120 and the rotation arm 224 of the second locking member 220, so that when the user releases the pressing of the pressing portion 221, the rotation arm 224 may be rotated to an original position by the elastic member 300. The disclosure illustrates that the elastic member 300 supports the rotation arm 224 and the detergent case 120, but is not limited thereto. Also, the disclosure illustrates that the elastic member 300 is a leaf spring, but is not limited thereto. For example, the elastic member 300 may include a coil spring.

The second locking portion 223 of the second locking member 220 may be provided to be locked to or unlocked from the first locking member 210.

The first locking member 210 may include a first locking portion 211. The first locking portion 211 may be provided to correspond to the second locking portion 223 so that the second locking portion 223 may be locked or unlocked. The first locking portion 211 may be formed to be in contact with the second locking portion 223. The first locking portion 211 may be disposed on at least a portion of the main body 10. The first locking portion 211 may protrude forward from the detergent case cover installation surface 61 of the front panel 20. The first locking portion 211 may be formed at a position corresponding to the second locking portion installation opening 125 and the second locking portion installation hole 134 of the detergent case 120. The first locking portion 211 may include a first locking surface 212 having a first angle θ1. The first locking surface 212 may be formed on a rear surface of the first locking portion 211. The first locking surface 212 may be disposed such that the second locking portion 223 may come into contact therewith.

The first angle θ1 of the first locking surface 212 may be formed at 90°+α.

The second locking portion 223 may include a second locking surface 226 provided to correspond to the first locking surface 212 and having an inclination of a second angle θ2. The second locking portion 223 may extend from the rotation arm 224 and may be bent upward from an end of the rotation arm 224, The disclosure illustrates that the second locking portion 223 is formed in a hook shape, but is not limited thereto.

The second locking surface 226 may be formed on at least one surface of the second locking portion 223. The second locking surface 226 may be formed on a front surface of the second locking portion 223. The second locking surface 226 may be provided to correspond to the first locking surface 212. The second angle θ2 of the second locking surface 226 may be greater than or equal to the first angle θ1. The second angle 82 of the second locking surface 226 may be formed at 90°+β. β may be greater than or equal to α. α may be 0 to 0.5 degree.

Because the second locking surface 226 of the second locking member 220 that is locked to the first locking surface 212 of the first locking member 210 has the inclination of the second angle θ2 greater than or equal to the first angle θ1, release of the locking between the first locking member 210 and the second locking member 220 that occurs due to the vibration caused by washing or dehydrating operation of the washing machine 1 is prevented.

Conversely, when the user presses the pressing portion 221 of the second locking member 220 with a slight force, the second locking portion 223 may rotate about the rotation shaft 222 to release the locking between the first locking surface 212 and the second locking surface 226.

Figure 8:
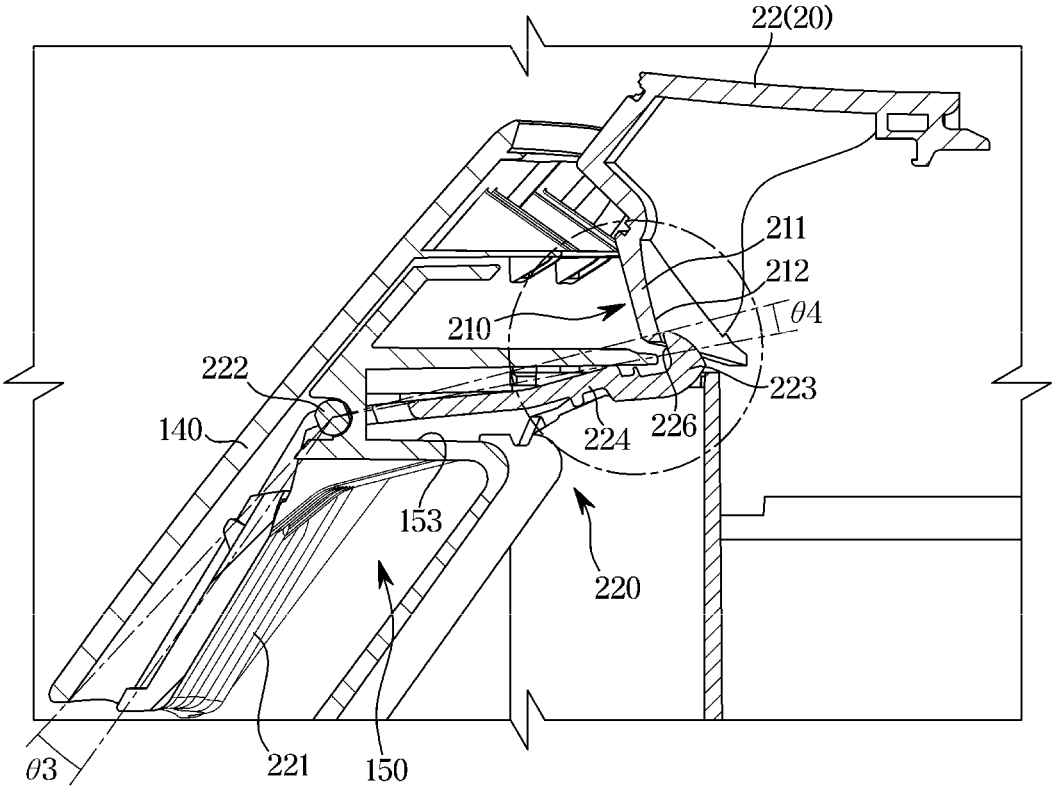
FIG. 8 illustrates the detergent case when the locking device is in a closing position according to an embodiment of the disclosure.
Figure 9:
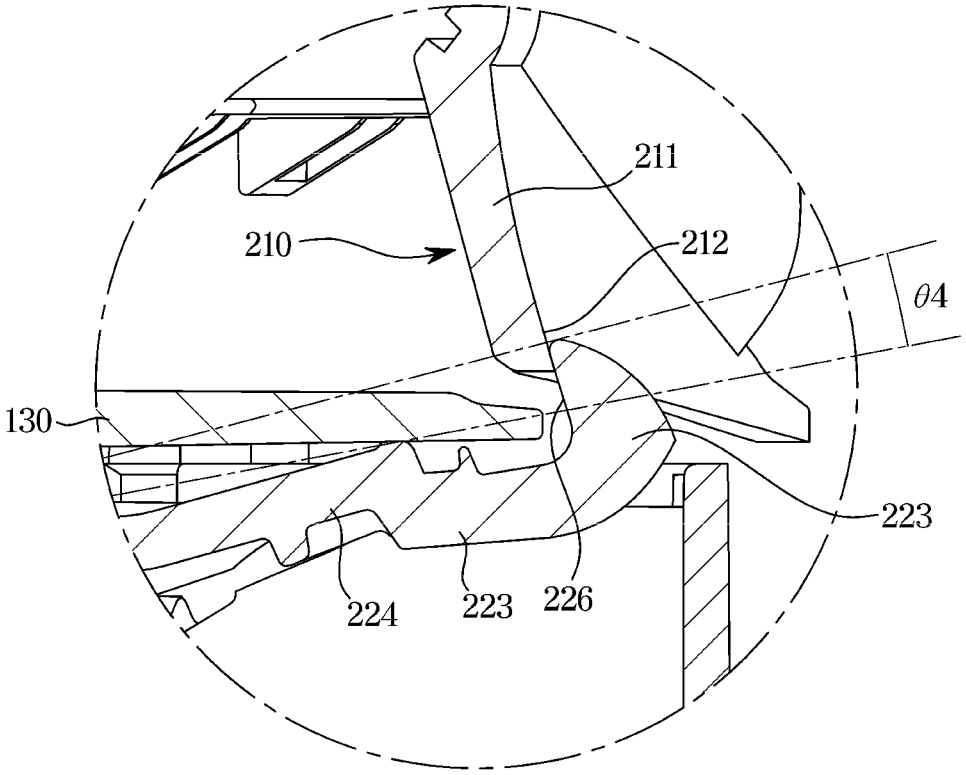
FIG. 9 is an enlarged view of a portion C in FIG. 8, illustrating a locking operation of the locking device according to an embodiment of the disclosure.
Figure 10:
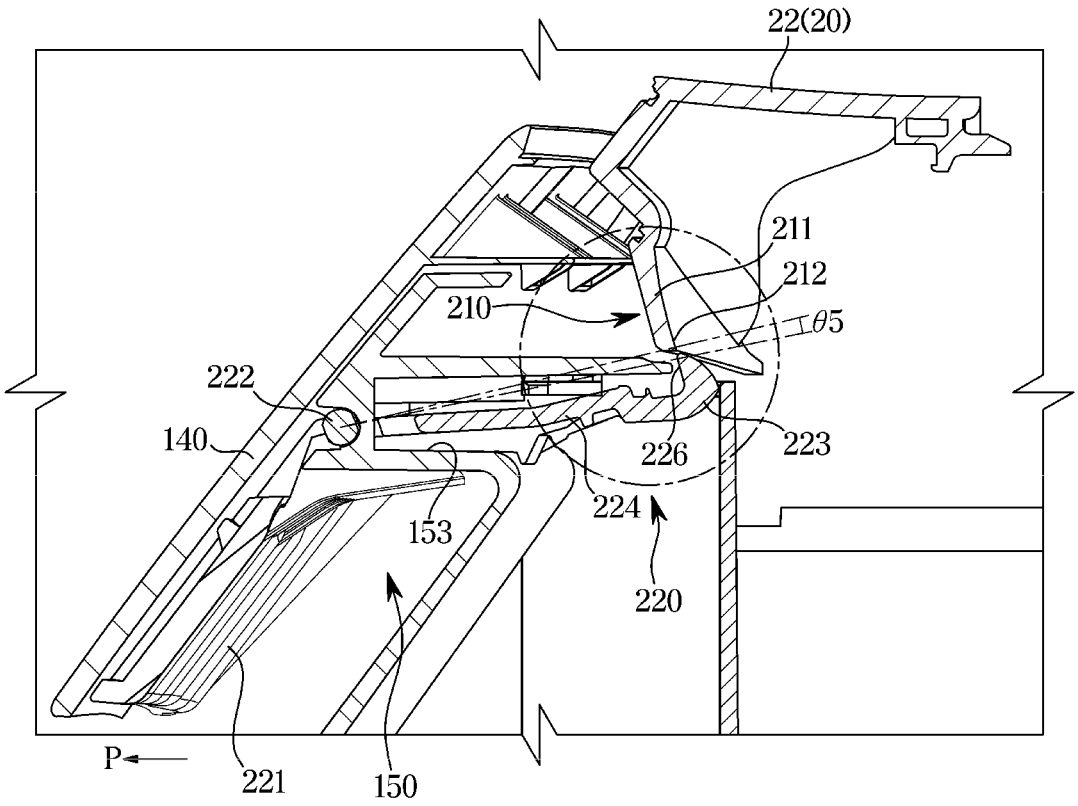
FIG. 10 illustrates the detergent case when the locking device is in an openable position according to an embodiment of the disclosure.
Figure 11:
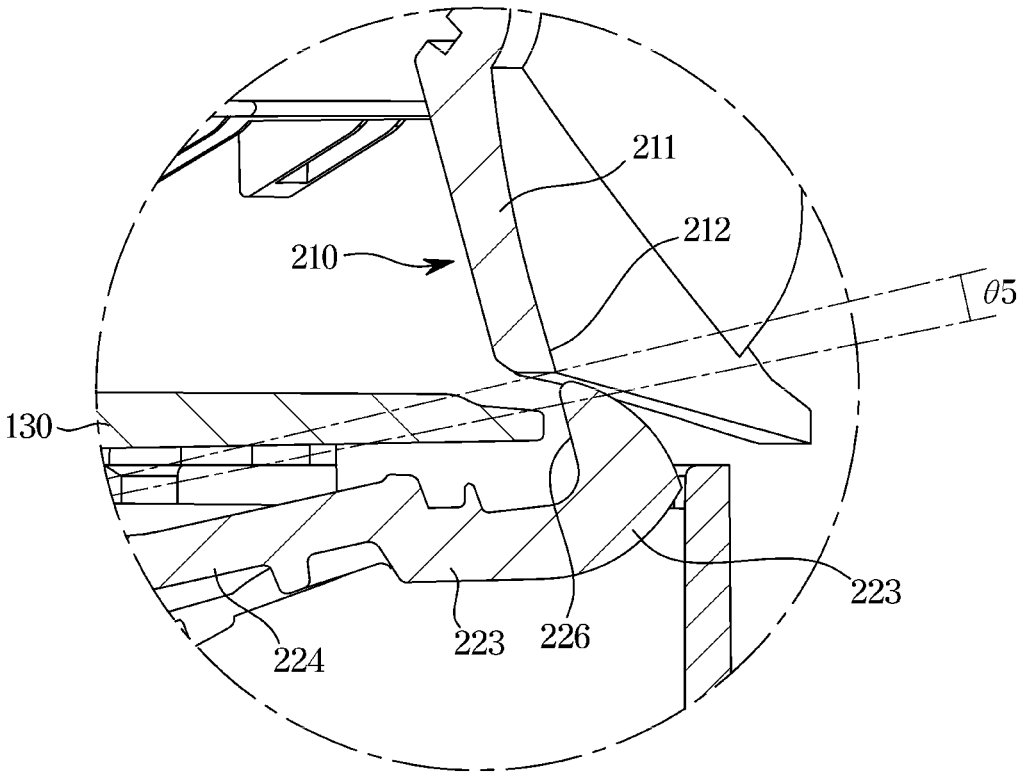
FIG. 11 is an enlarged view of a portion D in FIG. 10, illustrating an opening operation of the locking device according to an embodiment of the disclosure.
Figure 12:
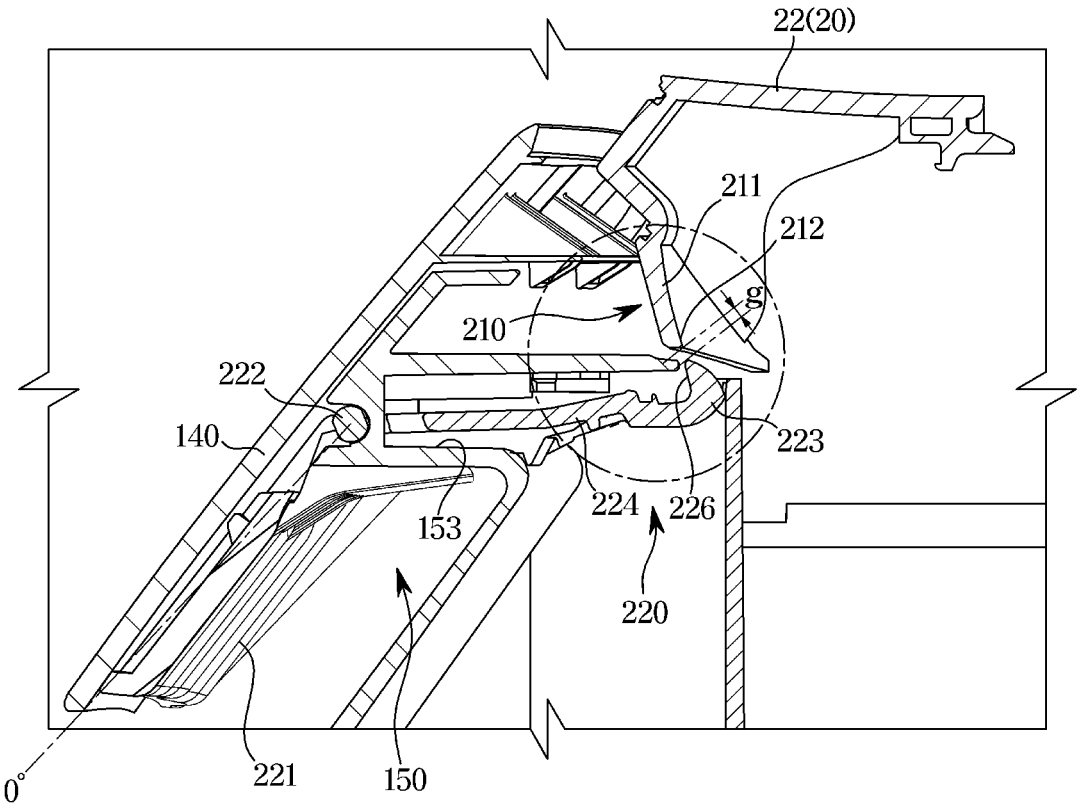
FIG. 12 illustrates the detergent case when the locking device is in an unlocking position according to an embodiment of the disclosure.
Figure 13:
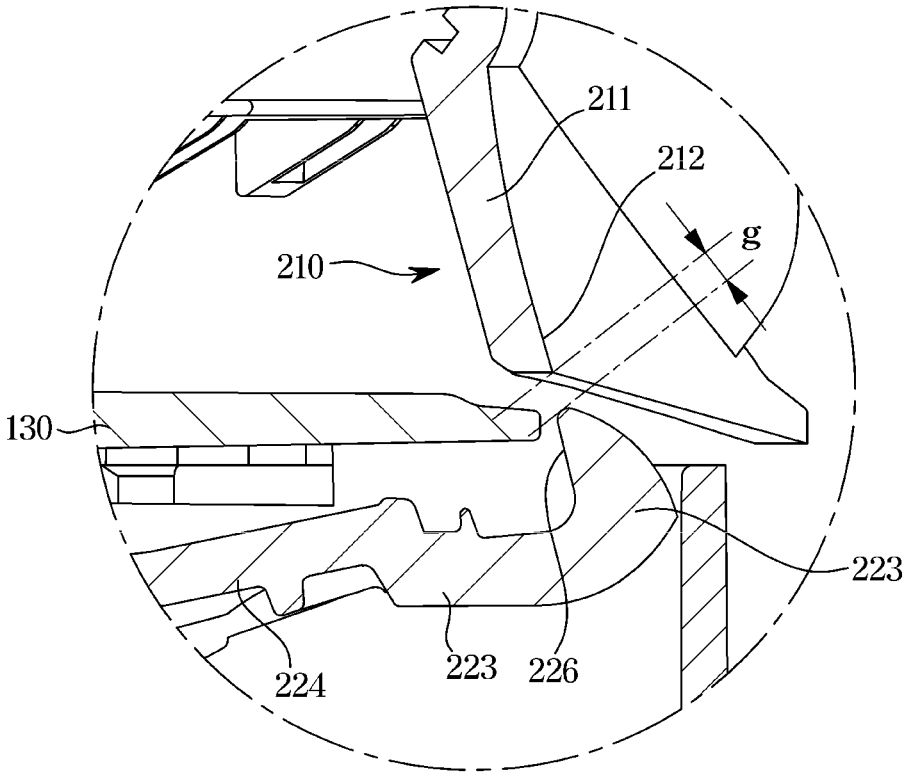
FIG. 13 is an enlarged view of a portion E in FIG. 12, illustrating an unlocking operation of the locking device according to an embodiment of the disclosure.

FIG. 8 illustrates the detergent case when the locking device is in a closing position according to an embodiment of the disclosure, FIG. 9 is an enlarged view of a portion C in FIG. 8, illustrating a locking operation of the locking device according to an embodiment of the disclosure, FIG. 10 illustrates the detergent case when the locking device is in an openable position according to an embodiment of the disclosure, FIG. 11 is an enlarged view of a portion D in FIG. 10, illustrating an opening operation of the locking device according to an embodiment of the disclosure, FIG. 12 illustrates the detergent case when the locking device is in an unlocking position according to an embodiment of the disclosure, and FIG. 13 is an enlarged view of a portion E in FIG. 12, illustrating an unlocking operation of the locking device according to an embodiment of the disclosure. Reference numerals not shown in the above drawings may be described with reference to FIGS. 1 to 7.

As illustrated in FIGS. 8 to 13, the locking/unlocking state between the detergent case 120 and the main body 10 by the locking device 200 will be described.

As illustrated in FIGS. 8 and 9, when the detergent case 120 is completely inserted into the detergent supply device installation portion 60 of the main body 10, the locking device 200 is in a locking state. The first locking member 210 and the second locking member 220 of the locking device 200 are locked to each other.

The first locking portion 211 of the first locking member 210 disposed on the detergent supply device installation portion 60 of the front panel 20 may protrude forward from the detergent case cover installation surface 61. The first locking surface 212 is formed on the rear surface of the first locking portion 211.

The second locking portion 223 of the second locking member 220 disposed in the detergent case 120 may be installed to protrude from the inside of the detergent case 120 to the outside. The second locking portion 223 may be provided to protrude through the second locking portion installation opening 125 of the detergent case 120. The second locking portion 223 may include the second locking surface 226 corresponding to the first locking surface 212 of the first locking portion 211. The second locking surface 226 may correspond to the first locking surface 212. The second locking surface 226 may be in contact with the first locking surface 212.

When the second locking surface 226 is in a locked state of being in contact with the first locking surface 212, the detergent case 120 is positioned in a completely dosed position in the main body 10. When the detergent case 120 is in the dosed state in the detergent supply device installation portion 60 of the main body 10, the pressing portion 221 of the second locking member 220 is disposed to be spaced apart from an inner surface of the detergent case cover 140 by a predetermined distance. In this case, the rotation shaft 222 of the second locking member 220 positions the pressing portion 221 at a third angle θ3. The third angle θ3 may be 3.5 degrees. In this case, the second locking surface 226 of the second locking member 220 may be positioned on the first locking surface 212 in an inclined state at a fourth angle θ4 from the rotation shaft 222, The fourth angle θ4 may be 4.5 degrees.

When the first locking portion 211 and the second locking portion 223 of the locking device 200 are in the locked state, the locking between the first locking surface 212 and the second locking surface 226 is not released even when vibration occurs by washing or dehydrating operation of the washing machine 1, so that the detergent case 120 may be prevented from being opened.

As illustrated in FIGS. 10 to 13, in order to separate the detergent case 120 from the detergent supply device installation portion 60 of the main body 10, the locking device 200 becomes in an unlocked state.

In order to separate the detergent case 120 from the main body 10, the first locking member 210 and the second locking member 220 of the locking device 200 may be opened by being unlocked with each other.

In order to open the detergent case 120 from the detergent supply device installation portion 60 of the main body 10, as illustrated in FIGS. 10 and 11, the pressing portion 221 of the second locking member 220 may be rotated forward (an arrow direction P) at a predetermined angle from an initial state of the locking device 200 by pressing of the user. The pressing portion 221 may be rotated about the rotation shaft 222.

The pressing portion 221 of the second locking member 220 is disposed to be spaced apart from the inner surface of the detergent case cover 140 by the predetermined distance. At this time, the rotation shaft 222 of the second locking member 220 positions the pressing portion 221 at a fifth angle θ5. The fifth angle θ5 may be 1.0 degree. In this case, the second locking surface 226 of the second locking member 220 may be positioned on the first locking surface 212 in an inclined state at the fifth angle θ5 from the rotation shaft 222. The fifth angle 85 may be 1.0 degree.

As illustrated in FIGS. 12 and 13, the user may further rotate the pressing portion 221 of the second locking member 220 to separate the second locking member 220 from the first locking member 210.

The user may further press the pressing portion 221 forward to come into contact with the inner surface of the detergent case cover 140. The pressing portion 221 may be rotated about the rotation shaft 222 until the pressing portion 221 comes into contact with the inner surface of the detergent case cover 140. At this time, the second locking surface 226 may be positioned to be spaced apart from the first locking surface 212 by a predetermined distance g.

As the second locking portion 223 is positioned to be spaced apart from the first locking portion 211 by the predetermined distance g, the first locking member 210 and the second locking member 220 are not in contact with or interfered with each other and may allow the detergent case 120 to be moved.

Accordingly, the user may release the locking device 200 between the detergent case 120 and the main body 10 by pulling the pressing portion 221 through the handle 141 of the detergent case cover 140, with a force required to open the detergent case 120, which is smaller than a force required to press the pressing portion 221, so that the detergent case 120 may be opened and closed without feeling of resistance, thereby improving usability.

As is apparent from the above, according to an embodiment of the disclosure, a locking structure of a detergent case can be improved to facilitate the withdrawal and entry of the detergent case.

In addition, the usability of a user can be improved by making a force for opening and dosing the detergent case constant.

While the disclosure has been particularly described with reference to exemplary embodiments, it should be understood by those of skilled in the art that various changes in form and details may be made without departing from the spirit and scope of the disclosure.

What is claimed is:

1. A washing machine comprising:

a main body including a front panel formed with an opening;

a tub configured to be disposed inside the main body to accommodate water;

a detergent case configured to supply a detergent to the tub, the detergent case including a detergent case body configured to accommodate the detergent and a handle in front of the detergent case body to be gripped by a user; and a locking device configured to couple the detergent case to the main body and decouple the detergent case from the main body, wherein the locking device comprises:

a first locking member disposed in the main body, and including a first locking portion having a first locking surface; and a second locking member including a pressing portion rotatably installed in the detergent case and a second locking portion extending from the pressing portion and having a second locking surface to correspond to the first locking portion, wherein the detergent case further includes a locking portion installation portion between the handle and the detergent case body to allow installation of the second locking member, when the second locking portion is locked with the first locking portion, the second locking portion is behind the locking portion installation portion, and when the second locking portion is unlocked from the first locking portion, the second locking portion is moved in front of the locking portion installation portion.

2. The washing machine according to claim 1, wherein the main body comprises a counterpart member which includes the front panel, and the counterpart member is configured such that the detergent case is coupleable to the main body using the first locking member which is provided on the counterpart member.

3. The washing machine according to claim 2, wherein the first locking portion is formed to be in contact with at least a portion of the second locking member, and the first locking surface which is inclined at an angle.

4. The washing machine according to claim 3, wherein the counterpart member which comprises at least one of the front panel that is provided in front of the main body comprises a frame provided inside the main body such that the detergent case is coupled.

5. The washing machine according to claim 4, wherein the first locking surface is formed on at least a portion of the counterpart member.

6. The washing machine according to claim 3, wherein the second locking member comprises:

a rotation shaft formed to support the second locking portion as the rotation shaft rotates by pressing of the pressing portion; and the second locking portion extends from the pressing portion toward the first locking portion.

7. The washing machine according to claim 6, wherein the angle at which the first locking surface is inclined is a first angle;

the second locking surface is inclined at a second angle; and the first locking surface and the second locking surface are in contact with each other responsive to the second locking member being pressed.

8. The washing machine according to claim 7, wherein the second angle is greater than or equal to the first angle.

9. The washing machine according to claim 6, further comprising an elastic member to elastically support the second locking member.

10. The washing machine according to claim 9, wherein the elastic member is disposed between the detergent case and the second locking member.

11. The washing machine according to claim 1, wherein the locking portion installation portion comprises:

a locking member accommodating groove to accommodate the second locking member;

a rotation shaft coupling portion above the locking member accommodating groove; and a locking portion through portion through which at least a portion of the second locking member penetrates and is rotatably installed.

12. The washing machine according to claim 11, wherein the locking portion installation portion comprises a locking member installation bracket configured such that the second locking member is rotatably installed.

13. The washing machine according to claim 11, wherein when the second locking portion is locked with the first locking portion, the second locking portion is exposed outside of the locking member accommodating groove of the locking portion installation portion.

14. The washing machine according to claim 11, wherein when the second locking portion is unlocked with the first locking portion, the second locking portion is moved inside of the locking member accommodating groove of the locking portion installation portion.

15. A washing machine comprising:

a main body including a front panel formed with an opening; and a detergent supply device mountable on the main body, wherein the detergent supply device comprises:

a detergent case configured to accommodate a detergent, the detergent case including a detergent case body configured to accommodate the detergent and a handle in front of the detergent case body to be gripped by a user; and a locking device locking or unlocking the detergent case such that the detergent case is coupleable to the main body or decoupleable from the main body, and wherein the locking device comprises:

a first locking member disposed in the main body, and including a first locking portion having a first locking surface; and a second locking member including a pressing portion rotatably installed in the detergent case and a second locking portion extending from the pressing portion and having a second locking surface to correspond to the first locking portion, wherein the detergent case further includes a locking portion installation portion between the handle and the detergent case body to allow installation of the second locking member, when the second locking portion is locked with the first locking portion, the second locking portion is behind the locking portion installation portion, and when the second locking portion is unlocked from the first locking portion, the second locking portion is moved in front of the locking portion installation portion.

16. The washing machine according to claim 15, wherein the first locking portion is formed to be in contact with at least a portion of the second locking member, and the first locking surface is inclined at an angle.

17. The washing machine according to claim 16, wherein the second locking member comprises:

a rotation shaft formed to support the second locking portion as the rotation shaft rotates by pressing of the pressing portion; and the second locking portion formed to extend from a pressing portion toward the first locking portion.

18. The washing machine according to claim 17, wherein the angle at which the first locking surface is inclined is a first angle;

the second locking surface is inclined at a second angle, and the first locking surface and the second locking surface are in contact with each other responsive to the second locking member being pressed.

19. The washing machine according to claim 18, wherein the second angle is greater than or equal to the first angle.

20. The washing machine according to claim 15, further comprising an elastic member disposed between the detergent case and the second locking member to elastically support the second locking member.

* * * * *